United States Patent [19]

Rosenwaks

[11] Patent Number: 4,752,674

[45] Date of Patent: Jun. 21, 1988

[54] CALCULATOR USED FOR DISPLAYING OVULATION SYNCHRONIZATION OF DONORS AND RECIPIENTS IN EMBRYO TRANSFER PROCEDURES

[76] Inventor: Zev Rosenwaks, 6th Floor, 825 Fairfax Ave., Norfolk, Va. 23507

[21] Appl. No.: 82,178

[22] Filed: Aug. 6, 1987

[51] Int. Cl.[4] ..... G06C 3/00

[52] U.S. Cl. ..... 235/88 RC; 235/78 RC; 235/85 FC

[58] Field of Search ..... 235/78 RC, 85 FC, 88 RC, 235/88 R

[56] References Cited

U.S. PATENT DOCUMENTS

| | | | |
|---|---|---|---|
| 2,808,206 | 10/1957 | Gomez-Rodriguez | 235/88 RC |
| 3,010,650 | 11/1961 | Aubect | 235/88 RC |
| 3,964,674 | 6/1976 | Van der Gaast | 235/88 RC |

*Primary Examiner*—B. R. Fuller

*Attorney, Agent, or Firm*—Millen & White

[57] ABSTRACT

A calculator used for displaying menstrual cycle synchronization of donors and recipients during embryo transfer procedures includes first, second and third members aligned with one another. In accordance with a preferred embodiment, the first member is a disc having the days of the menstrual cycle of the recipient thereon; the second member is a disc having dates of the monthly calendar thereon, and the third member is a disc having the days of the donor's menstrual cycle thereon. By aligning a window in the third disc with the seventeenth through nineteenth day of the recipient's menstrual cycle as displayed on the first disc, the days of the donor's cycle are substantially fixed. By then aligning the monthly dates on the second disc with the corresponding day on either the first or second disc, one may determine either when the recipient's cycle must start to synchronize with donor egg development or when the donor's egg must be stimulated in order to be available for transfer to the recipient when the recipient is most receptive to a successful transfer.

8 Claims, 4 Drawing Sheets

CALCULATOR USED FOR DISPLAYING OVULATION SYNCHRONIZATION OF DONORS AND RECIPIENTS IN EMBRYO TRANSFER PROCEDURES

BACKGROUND OF THE INVENTION

The instant invention relates to embryo transfer procedures. More particularly, the instant invention relates to a calculator for displaying synchronization of the ovulation cycles of a donor of at least one egg and a recipient of that egg during an egg transfer procedure.

Recent advances in reproductive medicine and reproductive technology have provided novel avenues for the treatment of infertility and have made it possible to achieve pregnancy in women previously thought to be irreversibly sterile.

The development of human in vitro fertilization (IVF) has successfully overcome female sterility due to absent, obstructed or irreparable fallopian tubes and has resulted in the extension of this technique to any etiologic infertility factor which cannot be satisfactorily treated with conventional methods, provided the partners involved have normal gametes and the female partner has a normal uterus. Recently, successful transfer of donor embryos and donor oocytes fertilized in vitro to recipient endometria has extended the use of in vitro fertilization technology to conditions where female gametes are either absent or are not readily accessible to oocyte harvest or where there is gametic abnormality resulting in in vitro fertilization failure. Moreover, the availability of donor oocytes has allowed the use of such gametes for testing fertilization potential in couples where repetitive IVF trials have resulted in lack of fertilization of apparently normal oocytes by seemingly normal spermatozoa. Accordingly, oocyte donation programs can be utilized in the treatment of human infertility as well as diagnostically to assess spermoocyte interactions. Although, medically, oocyte donation is analogous to sperm donation, technically the relative inaccessibility of female gametes and the relative difficulty of synchronizing the ovulatory process in the donor with endometrial maturation in the recipient make the procedures quite different.

While in vivo procedures have been successfully employed on a number of occasions, the transfer of in vitro fertilized donated oocytes to appropriately synchronized recipients appears to have wider clinical applications. In vitro procedures provide the added advantage of multiple oocyte collection in donors who are being stimulated with gonadotropines. Moreover, in vitro procedures do not require in vivo insemination of a donor with the inherent risks of undesired retained tubal or intrauterine pregnancy, and the possibility of transmitting semen born infectious diseases.

Success of all donor oocyte procedures depends on appropriate embryo-endometrial synchronization. Critical to the achievement of pregnancy is the procurement of a viable embryo which can be transferred into a receptive endometrial milieu.

In order to maximize the possibility of a successful transfer, it is necessary to synchronize the development of the fertilized donor egg with the menstrual cycle of the recipient. While the subtleties of such synchronization may be readily understandable to physicians engaged in transplant research, the subtleties are rarely understood by recipients and donors and can be confusing to medical support personnel as well as physicians in the field. Since it is necessary to develop and communicate information regarding synchronization to recipients and their spouses as well as donors, there is a need for a procedure or device for conveying such information in a simple, readily understandable format which can eventually become uniform throughout the practice.

SUMMARY OF THE INVENTION

It is an object of the instant invention to provide a calculator (menstrual cycle correlating device) for displaying information relating to the synchronization of the development of at least one donor egg with the menstrual cycle of a recipient of that egg so as to provide optimal conditions for successful transfer of the egg to the recipient.

Upon further study of the specification and appended claims, further objects and advantages of this invention will become apparent to those skilled in the art.

In view of the aforementioned object and other objects, the instant invention contemplates a calculator comprising a first member having numerals thereon spaced from one another to form a first array of numerals, wherein each numeral of the first array represents one day of the recipient's menstrual cycle. Aligned with and movable with respect to the first member is a second member. The second member has a second array of numerals thereon, spaced from one another, wherein each numeral of the second array represents one date of the monthly calendar. A third member is aligned with and movable with respect to both the first and second members. The third member has information relating to the donor's ovulation cycle thereon and a "window" therein, which window is alignable with the numerals on the first array so as to align with the time period in the recipient's menstrual cycle during which the possibility of the recipient becoming pregnant with an embryo developed from the fertilized egg is maximized. When the "window" is so aligned, the initial day of the donor's cycle is fixed with respect to the period of maximum receptivity of the recipient. If the second member is then positioned to align the date that the recipient's menstrual cycle starts with day one on the first number, the day for the start of the donor's cycle will be aligned with another date on the second member. Consequently, the calculator identifies the date on which the procedure for preparing the donor's egg for transfer should begin in order to have a properly prepared embryo for transferring to the recipient during the time that the recipient is most receptive of an embryo.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
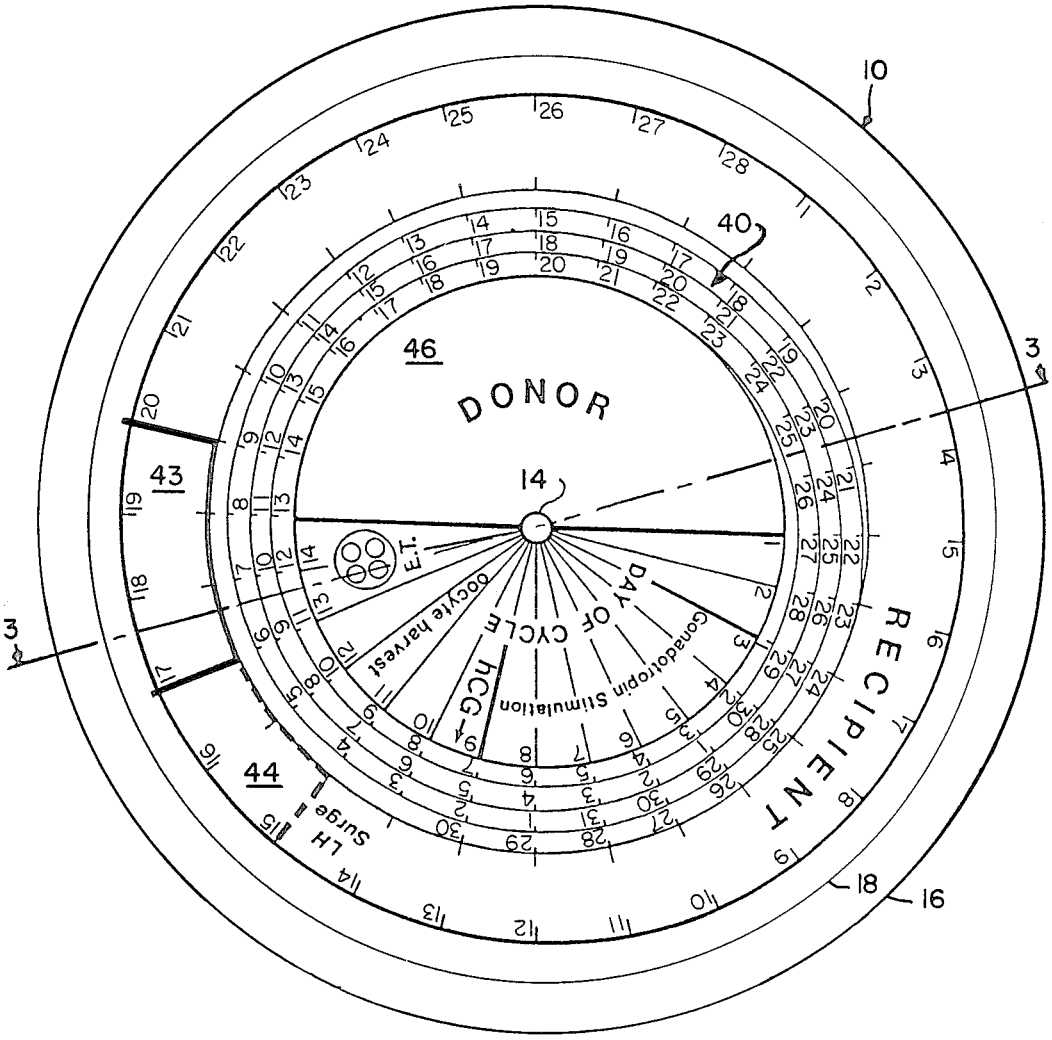
FIG. 1 is a top planar view of a device configured in accordance with the principles of the instant invention.

Referring now to FIG. 1, there is shown a calculator, designated generally by the numeral 10, configured in accordance with the principles of the instant invention. The calculator 10 assists a physician practicing embryo transfer procedures to coordinate the ovulation cycles of a recipient and donor with one another by displaying in a readily understandable fashion synchronization of those cycles with dates on the monthly calendar.

In order to maximize the possibility of the recipient becoming pregnant, it is desirable that synchronization of the donor and recipient be aimed to furnish at least one 4 to 16 cell embryo for transfer on the seventeenth to nineteenth day of the recipient's menstrual cycle with the day of the recipient's LH surge being arbitrarily defined as day fourteen of the recipient's cycle, day fifteen being designated as the day of ovulation. With women having ovarian failure, who have no ovarian function, estrogens and progesterone can be used to stimulate the necessary endometrial changes which will allow implantation to take place. In accordance with known procedures, the menstrual cycle of this recipient can be adjusted by administration of estrogen and progesterone in order to stabilize a recipient's menstrual cycle so as to be near or on a certain date, wherein the recipient's cycle can then be chronologically coupled to that of a donor whose cycle begins on a different date. Conversely, the donor's cycle can be coupled appropriately to the recipient's cycle by varying the day of the cycle of the donor when gonadotropin stimulation is initiated. As will be explained hereinafter, gonadotropin stimulation followed by administration of hCG is performed on the donor prior to harvesting the donor's oocyte for fertilization and transfer to the recipient. The donor's cycle has a critical fourteen day period which should ideally correspond with a fourteen day period of the recipient beginning at the fifth or sixth day and extending to the twentieth day of the recipient's cycle.

In practice the attending physician and the physician's staff must relate the cycles of the donor and recipient to particular calendar dates and keep the recipient, donor, physician and staff apprised of these calendar dates. In order to accomplish this, the calculator of FIG. 10 is set for a particular donor and recipient and then fixed by some means (such as stapling the elements of the calculator together). Duplicates of the calculator 10 are then placed in the charts of the donor and recipient and in the files of the physician or facility performing the service.

Figure 2:
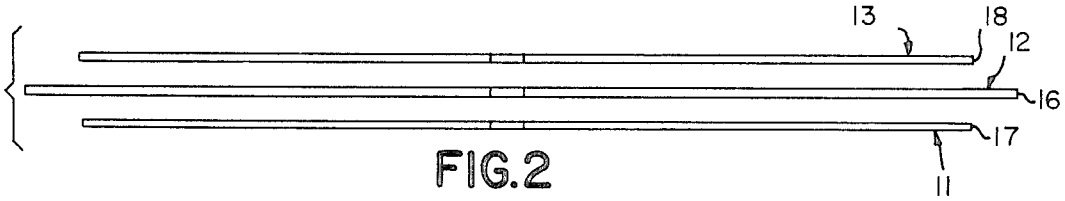
FIG. 2 is a side view of the invention of FIG. 1 with the components thereof shown in exaggerated spaced relation, for clarity.

Referring now more specifically to the structure shown in the drawings, it is seen that in the preferred embodiment of the calculator 10, the calculator is comprised of first, second and third, disks designated generally by the numerals 11, 12 and 13, which are held together by a centrally positioned rivet 14 around which each of the disks rotate so as to be adjustable one with another. As is perhaps best seen in FIGS. 2 and 3, the second disk 12 has a greater diameter than the first and third disks 11 and 13, respectively, between which the second disk is sandwiched so that the periphery 16 of the second disk is exposed beyond the peripheries 17 and 18 of the first and third disks, consequently, all three disks have an exterior surface allowing easy manual rotation of any one of the disks with respect to the two other disks. As is seen in dotted lines in FIG. 3, a staple 19 from a conventional desk stapler (not shown) is used to fix all three disks 11, 12, and 13, one with respect to the other after the menstrual cycles of both the recipient and donor have been determined and related to specific calendar dates.

Figure 4:
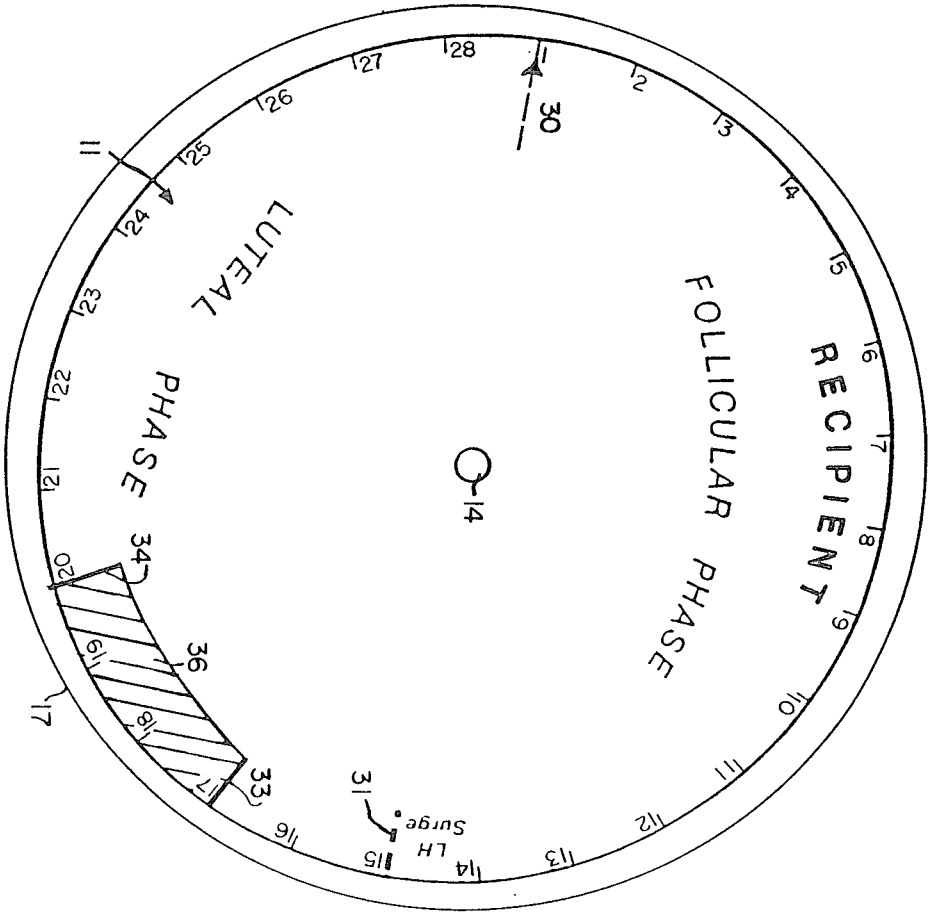
FIG. 4 is a top planar view of a recipient disk having numbers just inboard of the periphery thereof, the number corresponding to the days of the recipient's menstrual cycle.
Figure 5:
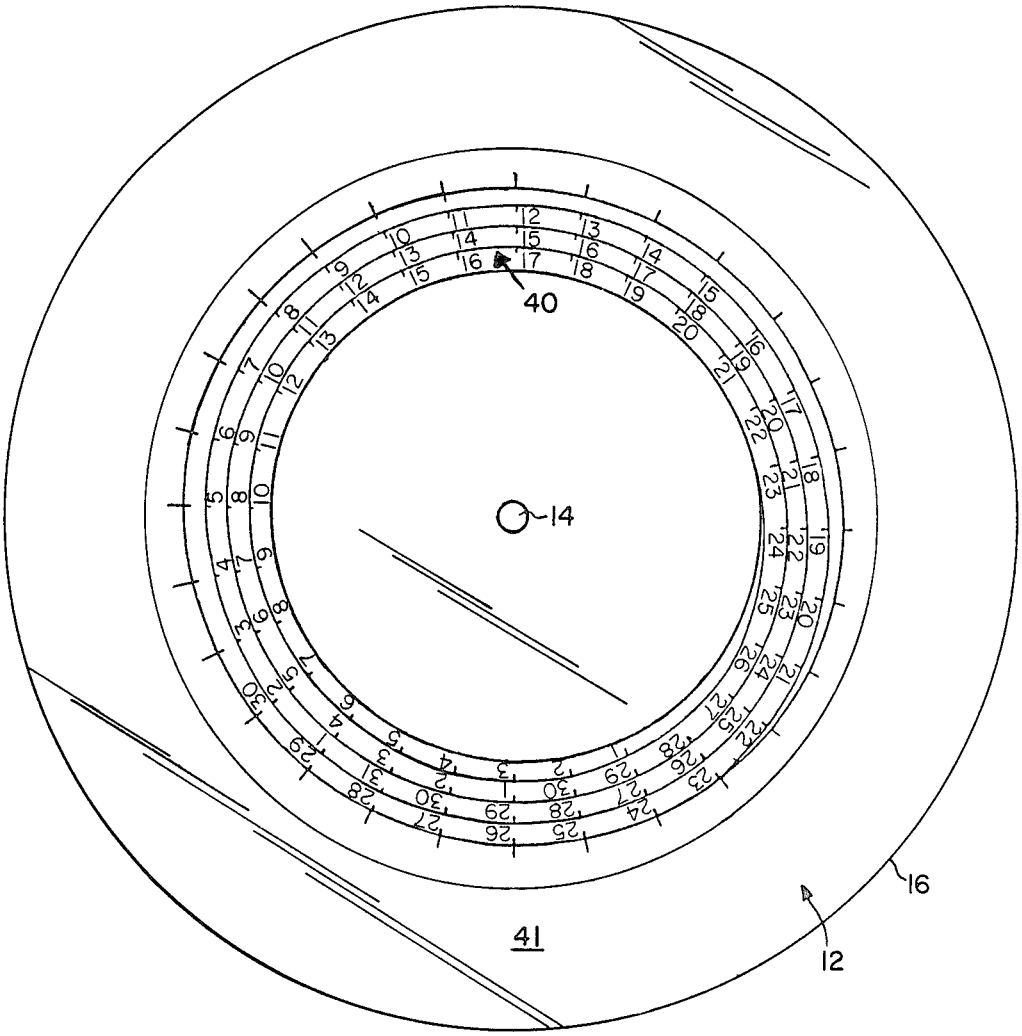
FIG. 5 is a top planar view of a calendar disk having the dates of three months arranged in a spiral fashion thereon.
Figure 6:
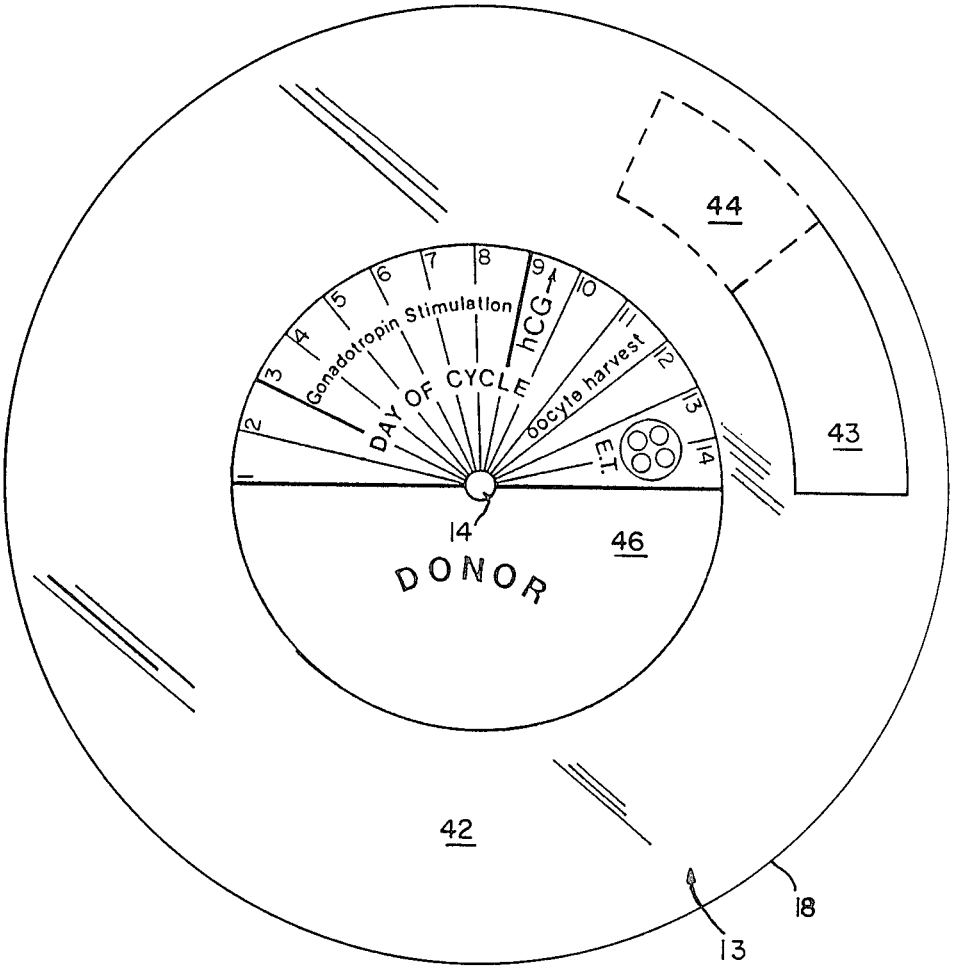
FIG. 6 is a top planar view of a donor disk having information relating to the donor's ovulation cycle thereon and a window for alignment with the numbers on the recipient disk of FIG. 4.

Considering now the individual disks 11, 12 and 13 as is shown in FIGS. 4, 5 and 6, it is seen that the disk 11 of FIG. 4 contains information regarding the recipient's menstrual cycle, the disk 12 of FIG. 5 contains monthly calendar information and the disk 13 of FIG. 6 contains information relating to the donor's ovulation cycle.

Referring first to FIG. 4, the recipient's disc or first disk 11 has adjacent its periphery 17, an array of numbers 1–28 just inside the periphery which corresponds to the typical 28-day menstrual cycle of a recipient. Adjacent day "1" of the array of days, there is an arrow 30 which visually emphasizes day "1" of the cycle. In addition, there is another arrow 31 at the fifteenth day of the cycle indicating the end of the LH surge and onset of ovulation which occurs between the fourteenth and fifteenth day of the cycle. A first hash mark 33 is at the seventeenth day of the cycle and a second hash mark 34 is at the twentieth day of the cycle so as to identify a "window 36" in the cycle which is the three-day period within the cycle that the recipient is most likely to subsequently become pregnant if implanted with an embryo.

Generally, day "1" through day "17" identifies the follicular phase of the cycle while day "17" through day "28" identifies the luteal phase of the cycle. Preferably, the disk is opaque and has a back surface upon which information relating to the particular embryo transfer is recorded, such as the names of the recipient and donor as well as other pertinent information.

Referring now to FIG. 5, which is divided into two portions, the first portion 41 of which is a transparent annular peripheral area to permit visualization of printed portion of disc 11, there is shown the calendar disc or second disk 12. The second disk has a diameter slightly greater than the first disk so that when placed thereupon, one may use ones fingers to engage the peripheral portion 16 in order to rotate the second disk. The second disk has calendar information thereon. Preferably, the calendar information is arranged in a spiral array 40 with the dates of three consecutive months contained within the spiral, which dates are spaced along the same radii as the days on discs 11 and 13. In that some months have thirty days and some months have thirty-one days while February has 28 or 29 days, it is preferable to provide separate batches of calculators 10 with various month groupings or to provide a plurality of discs 12 with various arrays of the possible monthly combinations and means to insert the desired version between discs 11 and 13. For example, one might conceivably provide four different calculators 10, each having one quarter of a year on the calendar year. If necessary, other calculators 10 having calendar information which sandwiches the third month of each quarter between adjacent months could also be provided so that most possibilities for three month spans can be covered. Each calculator 10 can have information on the back surface of the first disk 11 identifying the monthly time frame to which the calendar wheel relates or can be otherwise marked to identify monthly time frames such as having a specific color coding. In operation, the second disk 12 is rotated to align the proper date of the month with the day on disc 11 that the recipient's menstrual cycle begins.

Referring now to FIG. 6, the third disk 13, or donor disc, is divided into two portions. The first portion is an annular transparent area 42 which has a window 43 delineated therein, either as a cut-out portion or a portion of different, e.g., a clear portion with remainder of portion 43 being tinted. The window 43 is alignable with the array of days on the first disk 11 and preferably has a length equivalent to three days on the first disk. The window 43 may also have a separate section 44, shown in dotted lines, which has a length equal to two days so that it may align with the fifteenth and sixteenth day of the menstrual cycle following the LH surge of the recipient. Since the annular area 42 is transparent, one may view the annular array of date numbers 40 on the second disk 12 through the transparent annular area.

Disposed within the transparent annular area 42 is a circular area 46 which contains information relating to the donor's menstrual cycle. The circular area 46 is divided in half with one half being blank and perhaps having the words "DONOR" thereon while the other half includes radii indicating the first 14 days of the donor's menstrual cycle on radii corresponding to a like number of days of the recipient's cycle appearing on disc 11 and other relevant information such as the days for gonadotropins stimulation, the day of hCG administration, the day of oocyte harvest, the day of fertilization and the period for transplant of the conceptus to the recipient.

Generally, all donors undergo gonadotropin stimulation, which is preferably begun on day "3", day "4" or day "5" of the donor's menstrual cycle with perhaps an administration of two ampules of FSH in the morning, followed by two ampules of pergonal in the afternoon. Stimulation protocols for donors are not restricted to the foregoing schemes. Several stimulatory agents can be utilized. For example, pure FSH alone (Metrodin), clomiphene plus hMG or GnRH analogue in combination with gonadotropins may be used. Beginning on day 5, two ampules of pergonal are administration daily until critical follicular development is achieved, as judged by daily serum estradiols, ultrasonagrams and cervical mucus changes. Typically, hCG is administered in the evening of day "9" of the menstrual cycle and the oocyte harvest is scheduled approximately thirty-four to thirty-six hours later on day 11. After the oocytes are harvested, they are inseminated with spermetazoa, perhaps obtained from the husband of an infertile recipient. Typically, transfer of the resulting concepti occurs forty-four to seventy-four hours after insemination, depending on factors such as the recipient's luteal day, thus allowing for maximal synchronization of the endometrium and the conceptus. For example, if on the day of the donor's oocyte harvest, the recipient is on day "14" of her cycle, one may consider transferring the pre-embryo on day "17" or three days after insemination. It has been found that day "17" may be more suitable for transfer than day "16", since it allows for one more day of endometramaturation. It has also been found that there is a window between day "17" and day "20".

In use, the physician or physician's staff determines the date that the recipient's menstrual cycle begins and aligns that date on the second disc 12 with day 1 on the first disc 11. The first day of the donor's menstrual cycle, as depicted on third disc 13, is then aligned with the date of its occurrence as depicted in the array of numerals 40 on second disc 12. A determination is then made as to the sufficiency of overlap between the window 43 on disk 13 with the area 36 on the first disk 11. If the overlap is sufficient, then there is synchronization between the recipient and donor and the possibility of success of and embryo transfer between the two women is increased. The particular days of the donor's cycle are then followed by the physician in dosing the donor for gonadotropin stimulation, hCG administration and oocyte harvest. Subsequent fertilization and implantation can then take place, preferably on day "13" and "14" of the donor's cycle and days "17" through "19" of the recipient's cycle, as long as window 43 aligns with the area 36.

Figure 3:
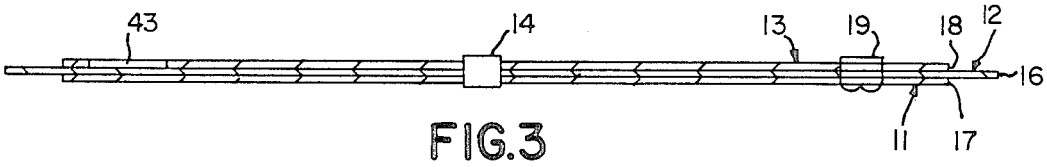
FIG. 3 is a cross section through FIG. 1 taken along lines 3—3 thereof.

In another approach, a particular donor may be selected for one reason or another and the recipient's menstrual cycle may be artificially induced, especially in women with ovarian failure by administration of estrogen and progesterone so that the recipient starts her menstrual cycle on a particular date which is appropriately synchronized with the date that the donor's cycle starts. In that gonadotropin stimulation does not necessarily have to occur three days after the beginning of the donor's cycle, should the donor for one reason or another be slightly off cycle, and for one reason or another be a particularly suitable match for the recipient, the administration of gonadotropin may occur at a later time in the donor's cycle. In order to accommodate situations such as this the third disc 13 is movable with respect to the first disc 11. The window 43 does not necessarily have to overlap the area 36 totally but may extend either beyond or behind the area 36. It is only necessary that a portion of the area 36 be overlapped. Once the recipient and donor cycles are synchronized, a staple such as the staple 19 as shown in FIG. 3, is driven through all three of the disks 11, 12 and 13 and the disks are deposited in the charts of the donor and recipient as well as the files of the physician or facility.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A calculator for displaying information relating to synchronization of the development of at least one donor egg with the menstrual cycle of a recipient of the donor egg after fertilization thereof so as to provide optimal conditions for successful transfer of the donor egg to the recipient, the calculator comprising:

a first member having numerals thereon spaced from one another by first spaces to form a first array of numerals, each numeral representing one day of the recipient's menstrual cycle;

a second member aligned with and moveable with respect to the first member, the second member having an array of numerals thereon spaced from one another by second spaces, each numeral representing one day of a monthly calendar; and a third member aligned with and moveable with respect to the first and second members, the third member having a first designated area in alignment with the array of numerals on the first member, the first designated area having a continuous length substantially equal to a specified number of successive days in the recipient's menstrual cycle during which recipient's chance of pregnancy is at a maximum, the third member further including a second designated area having indicia thereon representing the development of the donor egg, the indicia including numerals spaced from one another by third spaces, the numerals designating the days of the donor's ovulation cycle, from its initial day to a transplant day when the egg has been fertilized and become an embryo, the first, second and third spaces being alignable with one another wherein when the first day of the recipient's menstrual cycle as displayed on the first member is in alignment with the date thereof on the second member and the first designated area of the third member is aligned with at least a portion of the seventeenth through twentieth day in the array of numerals on the first member, the first day on the third member aligns with the date on the second member on which processing of the donor's egg should begin in order to maximize the possibility that the recipient will become pregnant when the fertilized egg is transferred to the recipient.

2. The calculator of claim 1 wherein the first, second and third members are in the form of superimposed first, second and third discs respectively, axially aligned with one another.

3. The calculator of claim 2 wherein the first disc is opaque with the first array of numerals being on one surface thereof; wherein the second disc is transparent with the second array of numerals being inboard of the first array of numerals on the first disc, and wherein the first designated area of the third disc is a window therein and the second designated area is a circular portion coaxial with the third disc, the indicia thereon including a plurality of radial lines each representing a day in the donor's menstrual cycle.

4. The calculator of claim 5 wherein the second disc is transparent and disposed between the first and third discs, the second disc having at least a portion which extends beyond the periphery of the first and second discs.

5. The calculator of claim 4 wherein the third disc has a transparent annular section in which the window is disposed.

6. The calculator of claim 5 wherein the numerals on the second member are arranged in a spiral array with numerals representing the dates of a plurality of months distributed along the spiral.

7. The calculator of claim 6 further including means for fixing the discs one with respect to another once synchronization has been determined.

8. The calculator of claim 1 further including means for fixing the discs one with respect to another once synchronization has been determined.

* * * * *